US006685451B1

(12) United States Patent
Ivey

(10) Patent No.: US 6,685,451 B1
(45) Date of Patent: Feb. 3, 2004

(54) VALVE ASSEMBLY FOR SUCKER ROD OPERATED SUBSURFACE PUMPS

(76) Inventor: Ray K. Ivey, 94 Elbow River Road, Calgary, Alberta (CA), T3Z 2V2

( * ) Notice: Subject to any disclaimer, the term of this patent is extended or adjusted under 35 U.S.C. 154(b) by 0 days.

(21) Appl. No.: 10/122,192

(22) Filed: Apr. 16, 2002

(51) Int. Cl.[7] ..... F04B 39/10; F04B 53/00

(52) U.S. Cl. ..... 417/555.2; 137/533.19; 137/543.19

(58) Field of Search ..... 417/555.2, 454, 417/554, 567, 569, 570; 137/533.15, 533.13, 533.11, 533.19, 539, 543.19

(56) References Cited

U.S. PATENT DOCUMENTS 1,555,068 A * 9/1925 Nixon ..... 137/533.15
1,759,081 A * 5/1930 Anderson ..... 137/533.15
2,461,206 A 2/1949 Fouse et al.
2,682,281 A * 6/1954 Ecker ..... 137/533.13
3,096,825 A 7/1963 Clark, Jr.
3,724,496 A * 4/1973 Secrist ..... 137/533.13
5,061,159 A 10/1991 Pryor
5,178,184 A * 1/1993 Skillman ..... 137/533.13
5,183,068 A 2/1993 Prosser
5,472,326 A * 12/1995 Tarpley ..... 417/454
5,593,289 A 1/1997 Tarpley
6,199,636 B1 3/2001 Harrison
6,283,148 B1 * 9/2001 Spears et al. ..... 137/533.15

* cited by examiner

*Primary Examiner*—Justine R. Yu
*Assistant Examiner*—Han L Liu
(74) *Attorney, Agent, or Firm*—Harrison & Egbert

(57) ABSTRACT

A valve assembly for an oil pumping system including a shell, a seat affixed in a lower end of the shell, a ball positioned within the shell and having a diameter greater than a diameter of the seat, and a cage positioned within the interior passageway of the shell. The cage has a first ported area and a second ported area on opposite sides of a ball retaining system. An elastomeric ring or a resilient member is positioned against a top of the cage.

18 Claims, 2 Drawing Sheets

VALVE ASSEMBLY FOR SUCKER ROD OPERATED SUBSURFACE PUMPS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to sucker rod operated subsurface pumps. More particularly, the present invention relates to traveling and standing valve assemblies as used on these pumps. More particularly, the present invention relates to cages used in association with such valve assemblies.

A conventional oil well includes a cased well bore with one or more strings of tubing extending downwardly through the casing into the oil or other petroleum fluid contained in the subsurface mineral formation to be produced. The casing is perforated at the level of the production zone to permit fluid flow from the formation into the casing, and the lower end of the tubing string is generally open to provide entry for the fluid in the tubing.

One type of pump conventionally employed in structures of the type described is wedged into an internal constriction or seating nipple formed internal of the tubing below the fluid level. A metallic enlargement on the external body of the pump prevents it from traveling below the seating nipple and resilient seal rings on the body of the pump housing act to form a leak-proof seal between the seating nipple and pump. The pump is generally driven by a mechanical linkage of metal rods, referred to in the trade as sucker rods which extend from the pump to the well surface. The sucker rod linkage is powered in a reciprocating motion by a conventional mechanical apparatus usually called a pumping unit located at the well surface.

The conventional pump itself generally includes a housing through which a piston is reciprocated by the sucker rod linkage. In its simplest form, the conventional pump of the type described often includes a number of ball and seat valves with one such valve associated with the piston or plunger (traveling valve) and another (standing valve) at the inlet port of the housing or barrel of the pump. On the upstroke of the plunger, the ball in the inlet port valve or standing valve is drawn away from its seat and the ball of the outlet port valve or traveling valve is forced over its seat to draw fluid from below the seating nipple and into the housing. On the piston downstroke, the ball in the standing valve is forced onto its seat and the ball in the traveling valve moves away from its seat to allow the plunger to move downwardly through the fluid contained in the housing. On the subsequent upstroke, the closing of the traveling valve forces the fluid above the plunger out of the housing through the outlet ports and into the tubing above the seating nipple and simultaneously fills the housing below the plunger with fluid. Repetition of this cycle eventually fills the tubing string and causes the fluid to flow to the surface.

Ball valve pumps are also relatively limited in theoretical efficiency and cycling rate due to their inherent principle of operation. Any increase in the amount of fluid which can be produced by such a pump usually involves an increase in the driving power and pump dimensions and includes a corresponding decrease in efficiency. Moreover, the valve closure time required for the ball and seat type valves restricts the speed of the pumping cycle and thereby further limits the maximum product on rate of pumps employing these valves.

In operation of a sucker rod pump, the plunger in the barrel is lifting the entire column of oil above the plunger on the upstroke. Thus, the load on the plunger is equal to the weight of the column of oil having a cross-sectional area of the pump plunger. The cross-sectional area of the pump plunger times the length of stroke equals the volume of oil being lifted on each pumping cycle.

A stationary barrel pump has the traveling valve assembly connected to the plunger and the standing valve made up in the lower end of the barrel. A traveling barrel pump has the traveling valve assembled with the barrel and the standing valve on the plunger. Although the present invention is particularly directed to the use of traveling valves, it can also be used as a standing valve assembly. The traveling valve assembly must be designed to allow the fluid that has entered the pump of the previous upstroke to pass through it with the smallest amount of pressure differential during the downstroke cycle of the pump. As the differential pressure increases, weight from the sucker rods directly above the pump is required to force the liquid through the plunger. If enough weight is taken from the rods to allow them to buckle slightly and to come into contact with the inside of the tubing string, then wear occurs both on the tubing string and on the sucker rods. The weight or force required to force the fluid through the traveling valve assembly is dependent upon the viscosity of fluid, the flow capacity of the traveling valve assembly and the pumping rate. As such, it is desirable to lower the force required to move the plunger through the fluid so as to increase pumping rate and overall system efficiency.

Another issue facing the traveling valve assembly is the issue of durability. During the pumping cycle, gas or vapor may occupy the space in the pump above the standing valve and below the traveling valve. On the downstroke of the pump, pressure is built up between the two valves until that pressure becomes slightly greater than the force of the fluid on top of the traveling valve due to the weight of the fluid above it. Water weighs 0.43 pounds per foot such that if the oil column weighs 0.4 pounds per foot, then in a well with the pump landed 5,000 feet from the surface, the pressure on the top of the traveling ball is 2,000 pounds per square inch. In normal pumping operations, with little or no gas in the pump at the start of the downstroke, this pressure is built up very quickly and the ball moves off of the seat and up against the top side of the cage while the plunger is at low velocities. If the pump is filled equally with liquid and gas, the traveling ball will remain on the seat until the plunger reaches midpoint on the downstroke where it will come into contact with the liquid in the pump. This will be at maximum plunger velocity. Pressure builds up immediately and forces the ball off of the seat with extreme force impacting the top inside of the cage. This force can cause damage or even break the cage in severe cases. As such, it is necessary to design the cage in such a manner so as to minimize the effects that this pumping operation can cause.

It is an object of the present invention to provide a valve assembly which maximizes the flow capacity of the fluid of the cage.

It is another object of the present invention to provide a valve assembly which minimizes the effects of traveling ball movement within the cage.

It is another object of the present invention to provide a valve assembly which maximizes the suspension time of solids within the fluids.

It is a further object of the present invention to provide a valve assembly which enhances flow capability of the fluid through the cage and through the tubing string.

It is a further object of the present invention to provide a valve assembly for an oil pumping system which maximizes efficiency or operational capacity of the oil pump.

It is a further object to provide a valve assembly which will withstand th severe forces associated with fluid pound conditions.

These and other objects and advantages of the present invention will become apparent from a reading of the attached specification and appended claims.

BRIEF SUMMARY OF THE INVENTION

The present invention is a valve assembly for an oil pumping system comprising a shell, a seat affixed at a lower end of the shell, a ball moveably positioned in the shell and a cage positioned within the interior passageway of the shell. The ball has a diameter greater than the interior diameter of the seat. The cage has an open bottom facing the seat and an open top facing the upper end of the shell. The cage has an upper portion, a lower portion and a ball retaining section. The cage has a first ported area formed in the lower portion between the bottom and the ball retaining section. The cage has a second ported area formed in the upper portion between the ball retaining section and the top.

In the present invention, the shell has an annular shoulder extending into the interior passageway. The seat has an end abutting the shoulder. A seat retainer has an upper end abutting a bottom of the seat such that the seat is fixedly interposed between the upper end of the seat retainer and the shoulder of the shell. The shell has interior threads at the lower end. The seat retainer has external threads at an upper end thereof threadedly affixed to these interior threads. The seat retainer has an interior passageway therethrough.

In the present invention, an elastomeric ring is positioned generally against the top of the cage. The elastomeric ring is retained within the interior passageway of the shell. A bushing has a lower end affixed within the upper end of the shell and abutting the elastomeric ring on a side opposite the cage.

The ball retaining section of the cage extends across an interior of the cage. The ball retaining section is concave with a contour generally matching a contour of the ball. The ball retaining section has a hole formed therethrough so as to open at one end to the first ported area and the opposite end to the second ported area.

The cage has a first flanged surface at the top thereof and a second flanged surface at the bottom thereof. Each of the first and second flanged surfaces has a diameter greater than a remainder of the cage. The diameter of each of the first and second flanged surfaces generally matches the diameter of the interior passageway of the shell. The first ported area has a plurality of ports opening through a wall of the cage. The second ported area has a plurality of ports also opening through a wall of the cage. The plurality of ports of the second ported area are helixed.

DETAILED DESCRIPTION OF THE INVENTION

Figure 1:
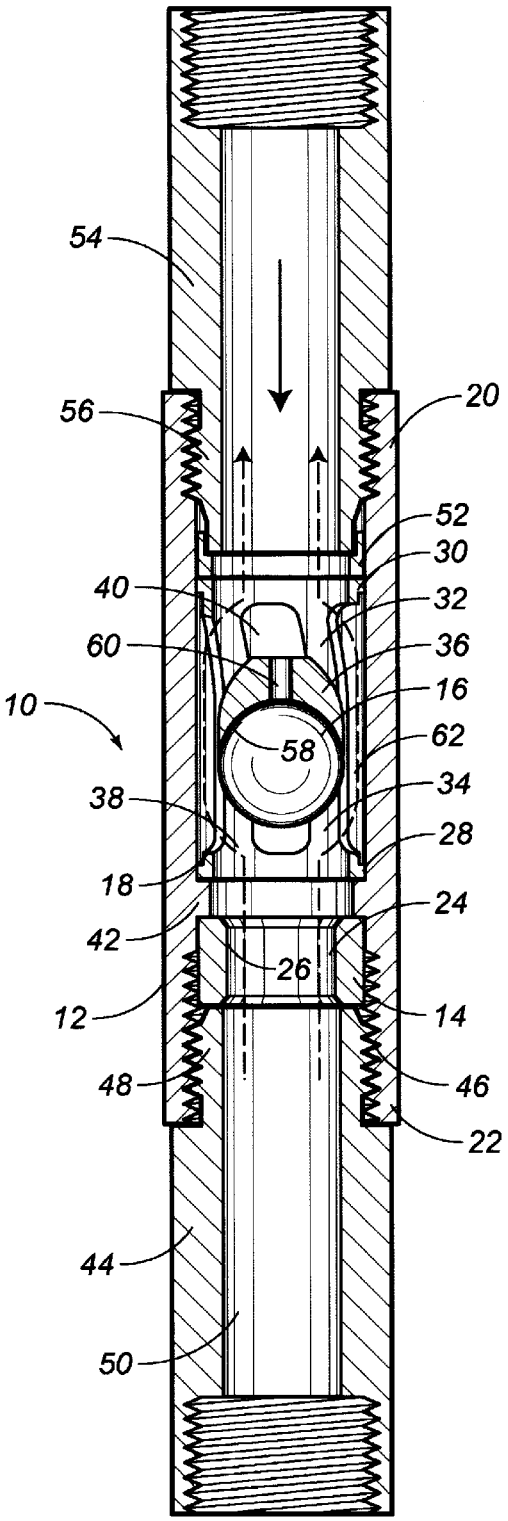
FIG. 1 is a cross-sectional view showing the valve assembly of the present invention illustrating, in particular, the downstroke of the valve assembly through the fluid.

Referring to FIG. 1, there is shown the traveling valve assembly 10 in accordance with the teachings of the present invention. The traveling valve assembly 10 includes a shell 12, a seat 14, a ball 16, and a cage 18. The shell 12 has an upper end 20 and a lower end 22. The shell 12 also has an interior passageway 24. The seat 14 is affixed within the lower end 22 of the shell 12. The seat 14 has an interior diameter 26. The ball 16 is moveably positioned within the shell 12. The ball 16 will have an outer diameter greater than the interior diameter 26 of the seat 14. The cage 18 is positioned within the interior passageway 24 of the shell 12. The cage 18 has an open bottom 28 facing the seat 14. The cage 18 also has an open top 30 facing the upper end 20 of the shell 12. The cage 18 has an upper portion 32, a lower portion 34 and a ball retaining section 36. The cage has a first ported area 38 formed in the lower portion 34 between the bottom 28 and the ball retaining section 36. The cage 18 has a second ported area 40 formed in the upper portion 32 between the ball retaining seat 36 and the top 30.

In FIG. 1, it can be seen that the shell 12 has an annular shoulder 42 standing into the interior passageway 24. The seat 14 has an upper end abutting the bottom of the shoulder 22. The bottom 28 of the cage 18 abuts the top surface of the shoulder 42. The seat 14 is properly retained in its desired position through the use of seat retainer 44. The seat retainer 44 has an upper end 46 abutting the bottom of the seat 14 such that the seat 14 is fixedly interposed between the upper end 46 of the seat retainer 44 and the bottom of the shoulder 42. The shell 12 has inner threads at the lower end 22 thereof. The seat retainer 44 has external threads 48 fixed to the interior threads of the bottom 42 of the shell 12. The seat retainer 44 also has an interior passageway 50.

An elastomeric ring 52 is positioned generally against the top 30 of the cage 18. This elastomeric ring 52 is retained within the interior passageway 24 of the shell 12. A bushing 54 has a lower end 56 which is affixed within the upper end 20 of the shell 12. The lower end 56 of the bushing 54 will abut the elastomeric ring 52 on a side opposite to the top 30 of the cage 18. In particular, the lower end 56 has external threads which are threadedly received by the interior threads of the upper end 20 of the shell 12. In high temperature applications, a temperature-resistant spring can be used in place of the elastomeric ring 52.

In the present invention, the ball retaining section 36 extends across an interior of the cage 18. The ball retaining section 36 has a concave surface 58 with a contour generally matching the contour of the ball 16. The ball retaining section 36 has a hole 60 formed centrally therein. The hole 60 has one end opening to the first ported area 38 and an opposite end opening to the second ported area 40.

It can be seen that the cage 18 has a first flanged surface at the top 30 and a second flanged surface at the bottom 28.

Each of the first and second flanged surfaces has a diameter greater than the remainder of the cage 18. As a result, an annulus 62 is formed between the exterior of the cage 18 between the bottom 28 and the top 30 and the interior surface of the shell 12. It is through this annulus 62 that oil, and other fluids, will flow during the pumping operation. Each of the flanged surfaces at the top 30 and the bottom 28 generally match the inner diameter of the shell 12.

In the present invention, the first ported area 38 has a plurality of ports opening through the wall of the cage 18. Similarly, the second ported area 40 has a plurality of ports opening through a wall of the cage. As can be seen in FIG. 1, the plurality of ports of the first ported area 40 are generally helixed.

FIG. 1 illustrates the manner in which oil, and other fluids, will pass through the cage 18. In particular, in FIG. 1, the traveling valve assembly 10 has been lowered by the sucker rods into the fluid at the bottom of the oil well. The force of the traveling valve assembly 10 encountering the fluid will cause the ball 16 to rise upwardly so as to contact the concave surface 58 of the ball retaining section 36. As a result, the fluids (illustrated in broken line fashion in FIG. 1) will pass through the first ported area 38 of the cage 18, travel in the annulus between the exterior of the cage 18 and the interior of the shell 12 so as to flow back through the plurality of ports of the second ported area 40 and upwardly into the interior of the bushing 54 and eventually through the remainder of the tubing string.

By providing the first ported area 38 and the second ported area 40 and annulus 62, the present invention increases the flow capacity of the traveling valve assembly 10. As a result, it is possible to lower the force required to move the plunger through the fluid and, as a result, increase pumping rates and overall system efficiency. The present invention has a greatly increased flow capacity by providing these two ported areas 38 and 40. In addition, the present invention increases flow capacity by providing a relatively large annulus 62. The results of flow tests conducted with the cage 18 of the present invention show increases from 30%–100% more than other cages that are on the market today.

The present invention provides a large surface area 58 at the ball retaining section 36. The contoured surface 58 is contoured to fit the exterior surface of the ball 16. Additionally, a hydraulic cushioning effect will occur so as to prevent metal-to-metal (ball-to-ball stop) contact. The ball 16 will have to force some amount of fluid out of the path of the ball before it can make contact with the surface 58 of the ball retaining section 36. As a result, the present invention minimizes the damaging effects from the result of explosive release of the ball from the seat 14. The present invention also uses helixed ports associated with the second ported area 40. These helixed ports 40 are above the point where the fluid motion imparts spin to the ball 16, while still imparting circular motion to the fluid. This helical or circular motion of the fluid will increase the suspension time of solids within the fluid. Additionally, the present invention allows for greater flow capability due to the vortexing of the fluid.

The present invention provides an additional cushioning effect through the use of the elastomeric ring 52 located at the top 30 of the cage 18. If a strong contact between the ball 16 and the concave surface 58 of the ball retaining section 36 should occur, much of this force will be absorbed through the distribution into the elastomeric ring 52. As a result, the impact of the ball 16 is reduced in two ways. First, the relatively large surface area associated with concave surface 58 of the ball retaining section 36 will distribute the force of the ball 16 over a larger area. Additionally, the elastomeric ring 52 will absorb additional forces imparted by the contact between the ball 16 and the ball retaining section 36.

Figure 2:
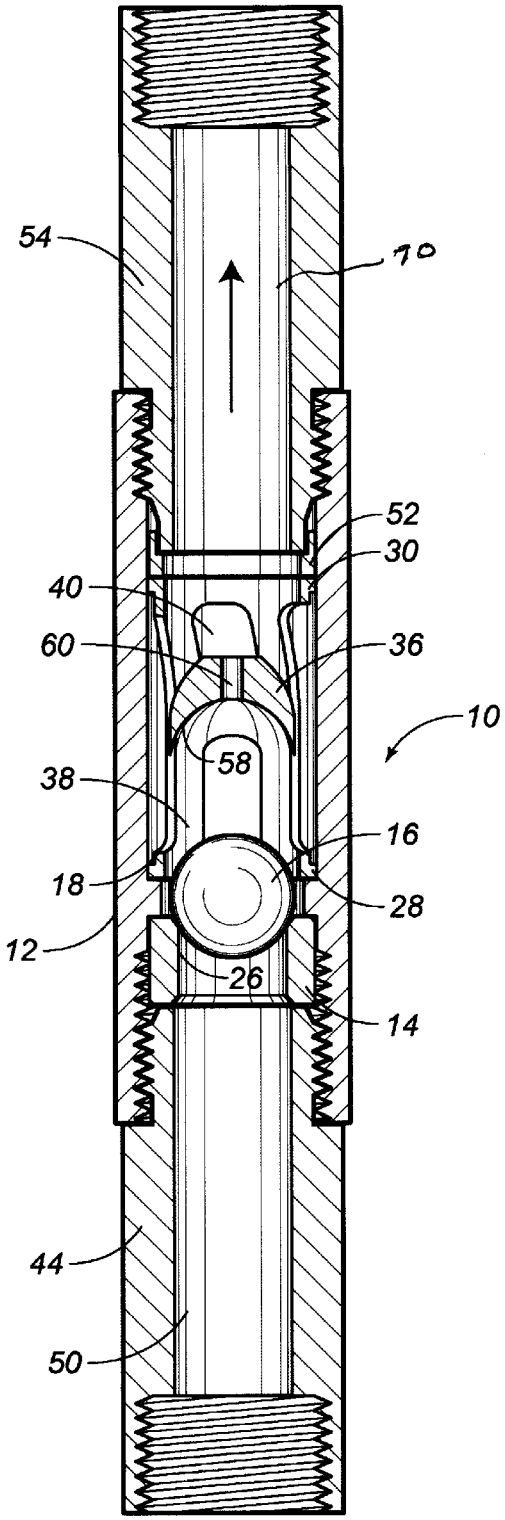
FIG. 2 is a cross-sectional view of the valve assembly of the present invention showing the movement of the valve assembly on an upstroke.

FIG. 2 shows the operation of the traveling valve assembly 10 as the traveling valve assembly 10 moves upwardly by the sucker rods of the oil pumping system. In FIG. 2, it can be seen that when the shell 12 is moved upwardly within the pump barrel, the force of the fluid string in the interior 70 of the tubing string will exert a downward force on the ball 16. As a result, the ball 16 will leave its position against the concave surface 58 of the ball retaining section 36 and will move downwardly through the interior of the cage 18. The ball will have a diameter greater than the diameter of the inner diameter 26 of the seat 14. As a result, the ball 16 will reside in surface-to-surface contact with the top of the seat 14 so as to prevent any liquids within the tubing string from flowing downwardly therethrough such as to enter the interior passageway 50 of the seat retainer 44 and back into the well.

Figure 3:
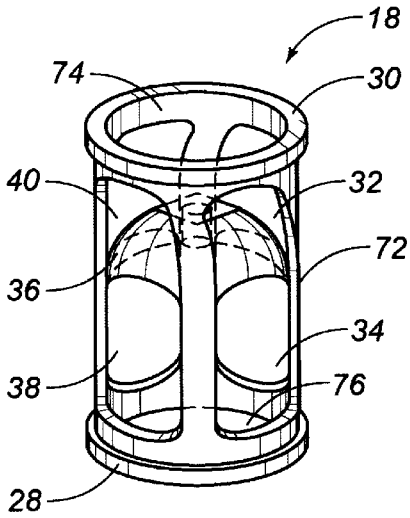
FIG. 3 is a perspective view of the cage in accordance with the teachings of the present invention.

FIG. 3 is an isolated view of the cage 18 of the present invention. The cage 18 has a body 72 having a top end 30 and a bottom end 28. An opening 74 is formed in the top end 30. Similarly, an opening 76 is formed in the bottom end 28. It can be seen that each of the bottom end 28 and the top end 30 is flanged outwardly from the remainder of the body 72 of the cage 18.

The cage 18 has an upper portion 32 and a lower portion 34. A ball retaining section 36 is formed between the upper portion 32 and the lower portion 34. A first ported area 38 is formed in the lower portion 34. Similarly, a second ported area 40 is formed in the upper portion 32. The ports associated with the first ported area 38 are rather longitudinal and straight. In contrast, it can be seen that the ports associated with the second ported area 40 are helixed. As a result, a spiral or vortexed flow pattern is imparted to the fluid which passes through the helixed ports associated with the second ported area 40.

Figure 4:
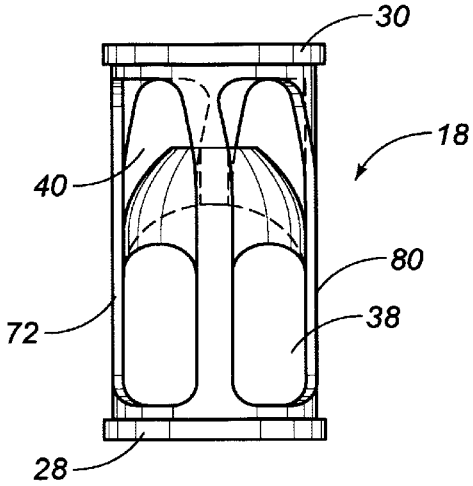
FIG. 4 is a side elevational view of the cage in accordance with the teachings of the present invention.

FIG. 4 further shows the configuration of the cage 18. In FIG. 4, it can particularly be seen how the ports associated with the first ported area 38 are rather straight. The ports of the second ported area 30 are formed through the wall 80 of the body 72 of cage 18. Since the ports of the first ported area 38 are relatively large, only longitudinal struts extend around the body 72. The bottom 28 is illustrated as being flanged so as to have an outer diameter greater than the remainder of the body 72. Similarly, the top 30 is illustrated as being flanged so as to also have an outer diameter greater than the retainer of the body 72. The second ported area 40 is particularly illustrated as having the helixed ports.

Figure 5:
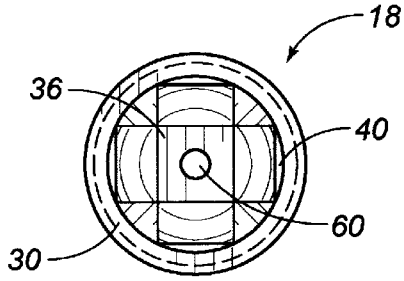
FIG. 5 is a plan view of the cage in accordance with the teachings of the present invention
Figure 6:
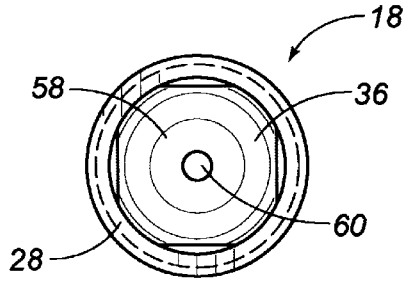
FIG. 6 is a bottom view of the cage in accordance with the teachings of the present invention.

FIG. 5 shows the top 30 of the cage 18. In FIG. 5, the arrangement of the ports of the second ported area 40 are particularly shown. The ball retaining section 36 is illustrated as having the hole 60 opening at the top thereof and into the second ported area 40. Similarly, FIG. 6 shows the bottom 28 of the cage 18. The concave surface 58 of the ball retaining section 36 is particularly illustrated. The hole 60 is shown as opening to the first ported area 38.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A valve assembly for an oil pumping system comprising:

a shell having an upper end and a lower end, said shell having an interior passageway;

a seat affixed in a lower end of said shell, said seat having an interior diameter;

a ball movably positioned within said shell, said ball having a diameter greater than said interior diameter of said seat; and a cage positioned within said interior passageway of said shell, said cage having an open bottom facing said seat and an open top facing said upper end of said shell, said cage having an upper portion and a lower portion and a ball retaining section, said cage having a first ported area formed in said lower portion between said bottom and said ball retaining section, said cage having a second ported area formed in said upper portion between said ball retaining section and said top, said cage having a first flanged surface at said top and a second flanged surface at said bottom, each of said first and second flanged surfaces having a diameter greater than that of a remainder of said cage.

2. The valve assembly of claim 1, said shell having an annular shoulder extending into said interior passageway, said seat having an end abutting said shoulder.

3. The valve assembly of claim 2, further comprising:

a seat retainer having an upper end abutting a bottom of said seat such that said seat is fixedly interposed between said upper end of said seat retainer and said shoulder of said shell.

4. The valve assembly of claim 3, said shell having interior threads at said lower ends, said seat retainer having external threads at said upper end thereof threadedly affixed to said interior threads, said seat retainer having an interior passageway.

5. The valve assembly of claim 1, further comprising:

a resilient member positioned generally against said top of said cage, said resilient member retained within said interior passageway of said shell.

6. The valve assembly of claim 5, further comprising:

a bushing having a lower end affixed within said upper end of said shell and abutting said resilient member on a side opposite said cage.

7. The valve assembly of claim 1, said ball retaining section extending across an interior of said cage, said ball retaining section being concave with a contour generally matching a contour of said ball.

8. The valve assembly of claim 7, said ball retaining section having a hole formed therethrough so as to open to said first ported area and to said second ported area.

9. The valve assembly of claim 1, said diameter of each of said first and second flanged surfaces generally matching a diameter of said interior passageway of said shell.

10. The valve assembly of claim 1, said first ported area having a plurality of ports opening through a wall of said cage, said second ported area having a plurality of ports opening through said wall of said cage.

11. The valve assembly of claim 10, said plurality of ports of said second ported area being helixed.

12. A cage for a traveling valve of an oil pumping system comprising:

a body having an open bottom and an open top, said body having an upper portion and a lower portion and a ball retaining section, said body having a first ported area formed in said lower portion between said bottom and said ball retaining section, said body having a second ported area formed in said upper portion between said ball retaining section and said top, said body having a first flanged surface at said top and a second flanged surface at said bottom, each of said first and second flanged surfaces having a diameter greater than an outer diameter of the remainder of said body.

13. The cage of claim 12, said ball retaining section extending across an interior of said body, said ball retaining section being concave and facing said bottom of said body.

14. The cage of claim 13, said ball retaining section having a hole formed therethrough so as to open at one end to said first ported area and at an opposite end to said second ported area.

15. The cage of claim 12, said first ported area having a plurality of ports opening through a wall of said body, said second ported area having a plurality of ports opening through said wall of said body.

16. The cage of claim 12, said plurality of ports of said second ported area being helixed.

17. The cage of claim 12, further comprising:

an elastomeric ring positioned generally against said top of said body, said elastomeric ring being an annular member having an interior diameter generally matching an interior diameter of said body.

18. The cage of claim 12, further comprising:

a seat affixed against said bottom of said cage, said seat having an interior diameter; and a ball moveably positioned within said first ported area of said cage, said ball having a diameter greater than said interior diameter of said seat, said ball retaining section being concave with a contour generally matching a contour of said ball.

* * * * *